US007686648B2

(12) United States Patent
Shen et al.

(10) Patent No.: US 7,686,648 B2
(45) Date of Patent: Mar. 30, 2010

(54) ELECTRICAL CONNECTOR HAVING AN IMPROVED HOUSING

(75) Inventors: Hui-Juan Shen, Kunshan (CN); Qing Wan, Kunshan (CN); Li-Chun Wu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/229,351

(22) Filed: Aug. 21, 2008

(65) Prior Publication Data

US 2009/0053933 A1 Feb. 26, 2009

(30) Foreign Application Priority Data

Aug. 21, 2007 (CN) ..... 2007 2 0045419 U

(51) Int. Cl.
*H01R 13/648* (2006.01)

(52) U.S. Cl. ..... 439/607.01; 439/676

(58) Field of Classification Search ..... 439/541.5, 439/489–490, 676, 607–610, 571–573, 701
See application file for complete search history.

(56) References Cited

U.S. PATENT DOCUMENTS 6,162,089 A * 12/2000 Costello et al. ..... 439/541.5
6,835,092 B2 * 12/2004 Wan et al. ..... 439/541.5
7,044,779 B1 * 5/2006 Liu ..... 439/541.5

FOREIGN PATENT DOCUMENTS

CN 2588614 11/2003

* cited by examiner

*Primary Examiner*—Edwin A. Leon
(74) *Attorney, Agent, or Firm*—Ming Chieh Chang; Wei Te Chung; Andrew C. Cheng

(57) ABSTRACT

An electrical connector (100) has an insulative housing (10) including a top wall (12), a bottom wall (13) and a pair of opposite side walls (14), an upper shell (31) and a lower shell (32) locking with the upper shell. The upper shell has a top plate (311) and a pair of side plates (312) at least partially enclose the bottom and the side walls of the housing. The upper shell has a bottom plate (321) and a pair of side wings (322) at least partially enclosing the top and the side walls of the housing. Each side wall of the insulative housing includes a flange portion (17) protruding outwardly therefrom. The side wing of the lower shell are guided onto the side plates of the upper shell by the flange portions and partially overlapping with the upper shell.

15 Claims, 6 Drawing Sheets

ELECTRICAL CONNECTOR HAVING AN IMPROVED HOUSING

BACKGROUND OF THE INVENTION

1. Field of the Invention

The present invention relates to an electrical connector, and particularly to an electrical connector having an improved insulative housing for easily mounting a shell to the insulative housing.

2. Description of Prior Arts

A conventional electrical connector is described in Chinese Patent No. CN2588614 issued on Nov. 26, 2003. The electrical connector includes a housing, a lower shell mounted onto the housing and having a number of protrusions stamped therefrom, and an upper shell providing corresponding recesses for locking with the lower shell. However, when the upper shell is assembled onto a bottom portion of the housing for engaging with the lower shell, it is apt to cause a collision of the upper shell and lower shell, which will result in a complex process and a high manufacture cost during assembly of such upper shell to the housing.

Hence, it is desirable to provide an improved electrical connector to overcome the aforementioned disadvantages.

SUMMARY OF THE INVENTION

An object of the present invention is to provide a electrical connector having an insulative housing having a pair of flange portions respectively disposed on opposite side walls of the housing for easily assembling a lower shell onto the insulative housing and locking with an upper shell.

To achieve the above object, an electrical connector has an insulative housing comprising a top wall, a bottom wall, a pair of opposite side walls and a receiving space defined therebetween, a terminal module mounted into the receiving space, an upper shell and a lower shell locking with the upper shell. The lower shell has a top plate and a pair of side wings surrounding the bottom wall and side walls of the housing. The upper shell comprises a top plate and a pair of side plates at least partially enclosing the top and the side walls of the housing. Each side wall of the insulative housing comprises a flange portion protruding outwardly from the side wall, the side wings of the lower shell are guided onto the side plates of the upper shell by the flanges and partially overlapping with the upper shell.

Advantages of the present invention are to provide an insulative housing having a pair of flange portions respectively stamped from the side wall. The side wing of the lower wall is guided onto the side plates of the upper shell by the flanges and partially overlapped with the upper shell. Therefore, it is easy to assemble the lower shell to the insulative housing and effective to avoid a damage of the lower shell and the upper shell.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
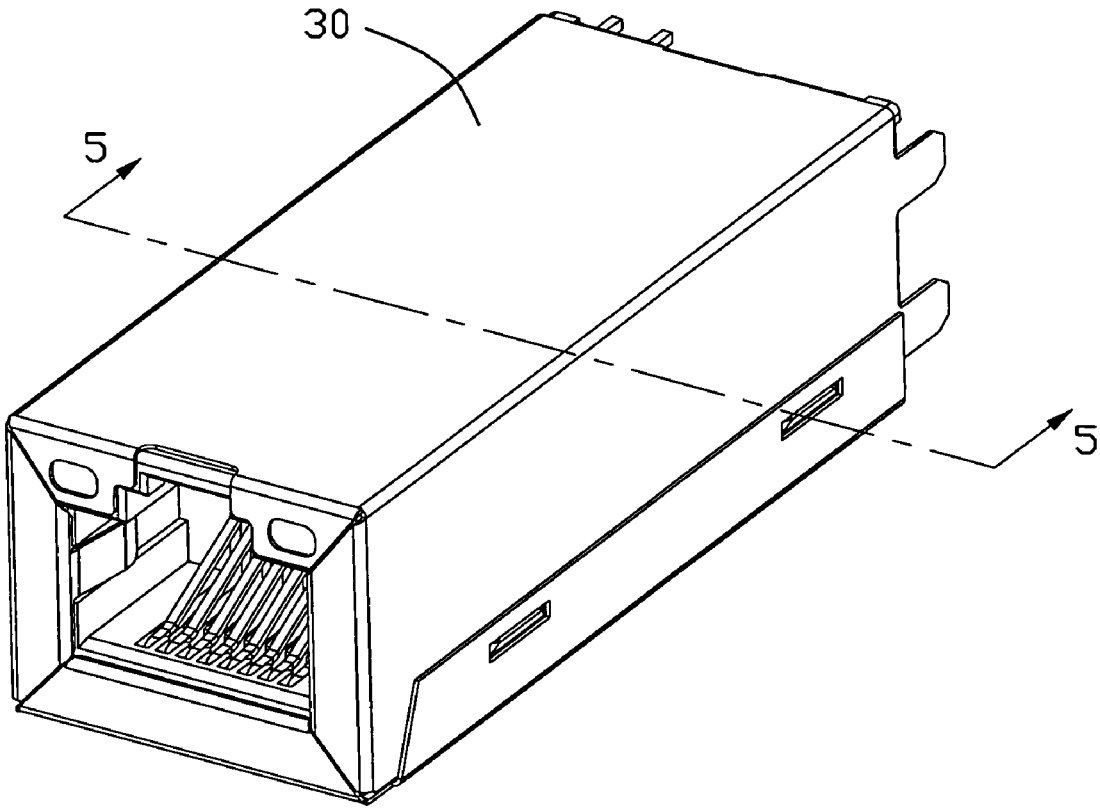
FIG. 1 is an assembled perspective view of an electrical connector according to the present invention.
Figure 2:
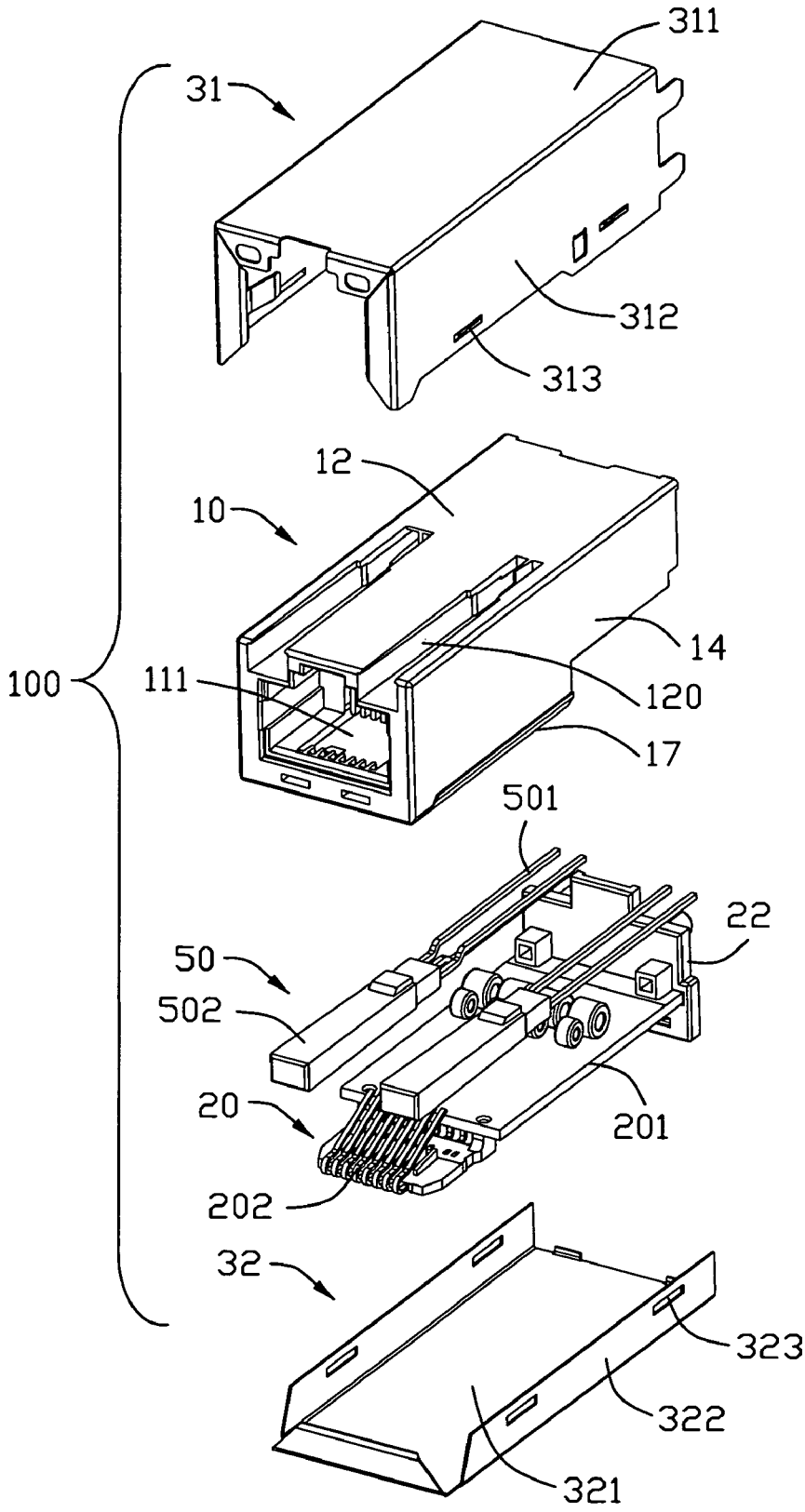
FIG. 2 is an exploded view of the electrical connector as shown in FIG. 1.
Figure 3:
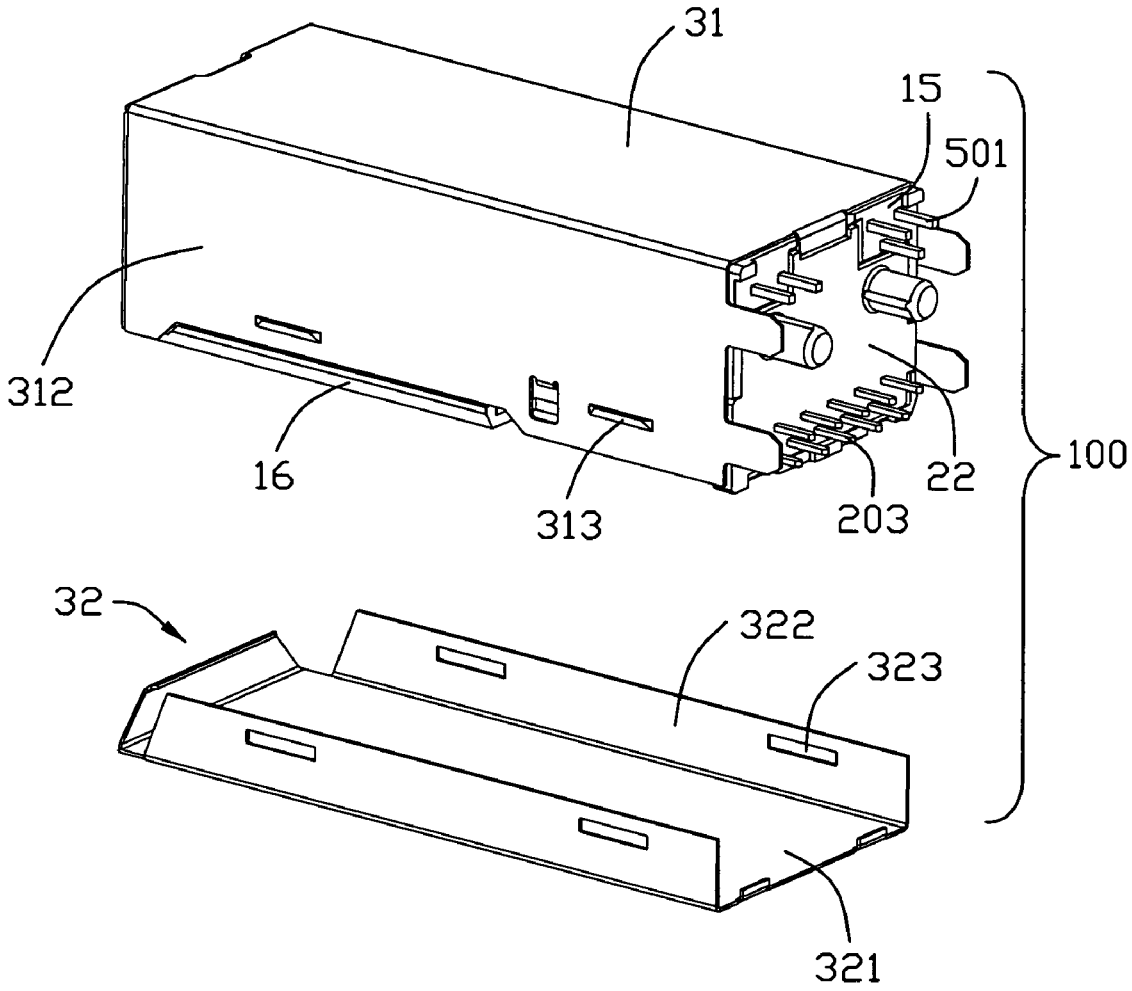
FIG. 3 is a partially assembled perspective view of an insulative housing when a lower shell is not mounted on the insulative housing.
Figure 4:
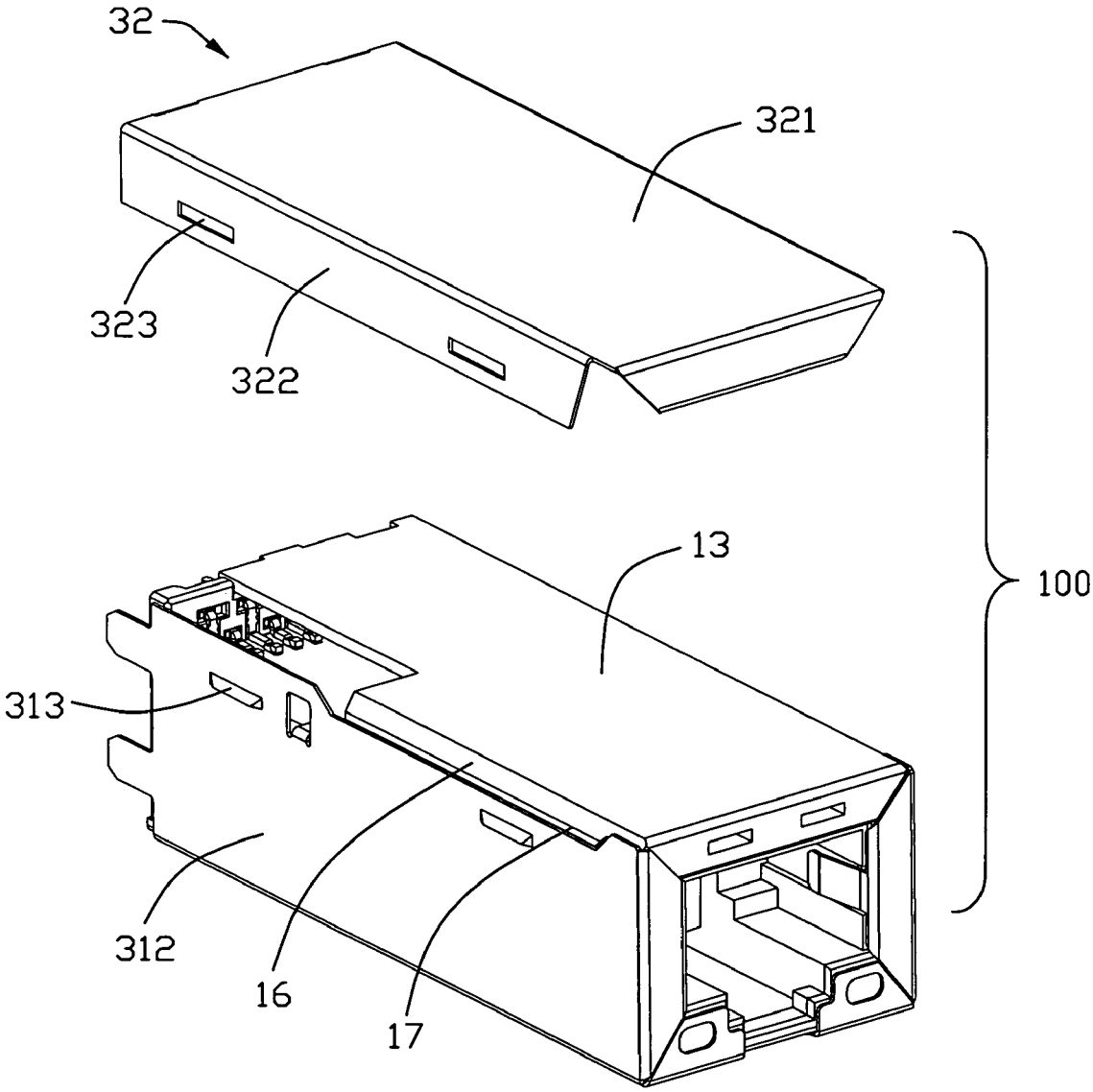
FIG. 4 is a perspective view similar to FIG. 3, taken from another aspect.
Figure 5:
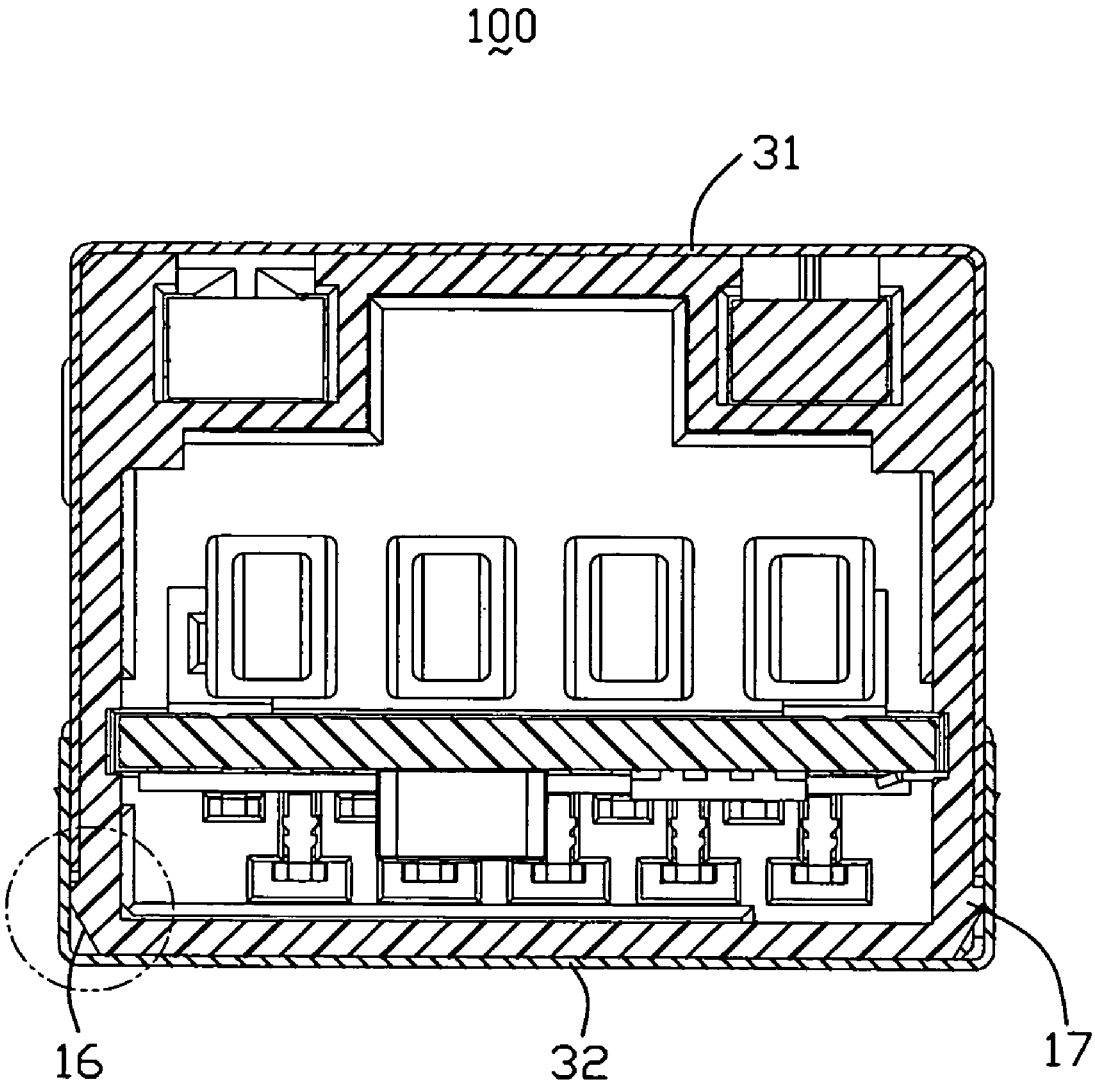
FIG. 5 is a cross-sectional view of the electrical connector taken along line 5-5 of FIG. 1.
Figure 6:
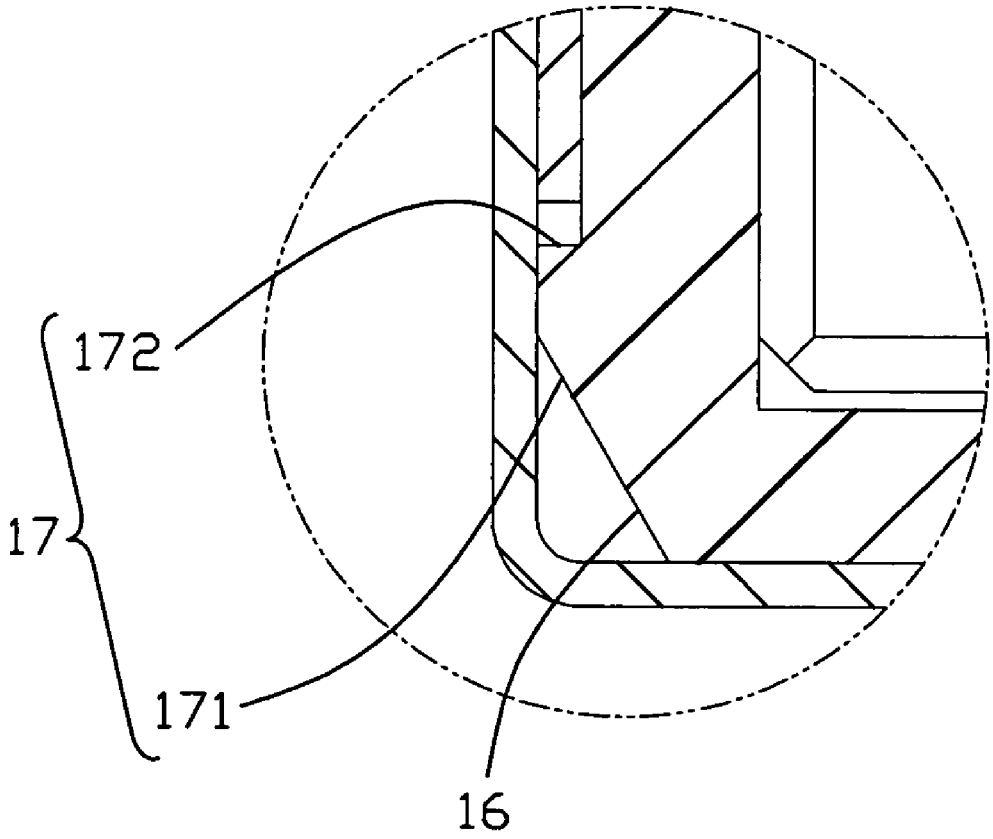
FIG. 6 is an magnifying view of a flange portion of the insulative housing, as especially labeled in FIG. 5.

Reference will now be made to the drawing figures to describe the present invention in detail. Referring to FIGS. 1-5, an electrical connector 100 adapted for engaging with a mating plug (not shown) in accordance with the present invention comprises an insulative housing 10, a terminal module 20 mounted to the insulative housing 10, a pair of visual indicators 50, an upper shell 31 enclosing the insulative housing 1 and a lower shell 32 for locking with the upper shell 31.

The visual indicator 50 for indicating a condition of an electrical signal comprises a lighting pipe 502, a pair of pins 501 extending through a rear wall 15 of the housing 10 for connecting with a mother printed circuit board (not shown).

Referring to FIGS. 2-5, the insulative housing 1 has a top wall 12 defining a pair of slots 120 for retaining the visual indicators 50, a bottom wall 13, a pair of opposite side walls 14 and a receiving space 111 defined therebetween for receiving the terminal module 50, and a guiding section 16 formed on a conjunctive portion of the bottom wall 13 and the side wall 14 for guiding the lower shell 32. Each side wall 14 of the housing 10 has a flange portion 17 protruding outwardly therefrom along a lengthwise direction of the side wall 14. The flange portion 17 of the housing 10 is formed as wedge-shaped and comprises a slantwise portion 171, a perpendicular portion 172 in parallel with the side wall 14.

The terminal module 20 comprises a printed circuit board 201, a plurality of contacts 202 mounted to a front section of the printed circuit board 201 and received in the receiving space 111 for electrically connecting with the mating plug, and a medial member 22 mounted to a bottom portion of the printed circuit board 201. The medial member 22 has a plurality of terminals 203 assembled thereto and extending downwardly for connecting with the mother printed circuit board.

The upper shell 31 has a top plate 311 and a pair of side plates 312 for enclosing the top wall 12 and side walls 14 of the insulative housing 10. The lower shell 32 comprises a bottom plate 321, and a pair of side wings 322 surrounding the bottom wall 13. The side plate 312 of the upper shell 31 comprises a plurality of ribs 313 stamped therefrom for engaging with corresponding slits 323 defined in the side wing 322 of the lower shell 32. The flange portion 17 has a thickness equal to a thickness of the side plate 312 of the upper shell 31.

In assembling, firstly, the terminal module 20 is mounted to the insulative housing 10, the contacts 202 are received in the receiving spaces 111. Secondly, the visual indicators 50 are retained into the slots 120 of the insulative housing 10. Finally, the upper shell 31 is mounted onto the insulative housing 10. The lower shell 32 is guided by the guiding section 16 and moved along the wedge-shaped long flange portion 17 in a top-to-bottom direction and locking with the upper shell 31 by the engagement of the ribs 313 and the slits 323.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector; comprising:

an insulative housing comprising a top wall, a bottom wall, a pair of opposite side walls and a receiving space defined therebetween, said insulative housing comprising a flange portion protruding outwardly from the side wall and formed on a conjunctive portion of the bottom wall and the side wall;

a terminal module mounted into the receiving space of the insulative housing;

an upper shell comprising a top plate and a pair of side plates at least partially enclosing the top and the side walls of the insulative housing, the side plate of the upper shell is hidden behind the flange portion; and a lower shell comprising a bottom plate and a pair of side wings surrounding the bottom wall and locking with the upper shell, the side wings of the lower shell guided onto the side plates of the upper shell by the flange portions and partially overlapping with the upper shell.

2. The electrical connector as claimed in claim 1, wherein said flange portion of the insulative housing is wedge-shaped.

3. The electrical connector as claimed in claim 2, wherein each side plate of the upper shell comprises a plurality of ribs stamped and engaging with corresponding slits defined in the side wing of the lower shell.

4. The electrical connector as claimed in claim 1, wherein said insulative housing comprises a guiding section formed on the flange portion to guide the lower shell to overlap the upper shell for avoiding collision formed between the lower the shell and the upper shell.

5. The electrical connector as claimed in claim 1, wherein said flange portion has a thickness equal to a thickness of the side plate of the upper shell.

6. The electrical connector as claimed in claim 1, wherein said terminal module comprises a printed circuit board, a plurality of contacts mounted to a front section of the printed circuit board, and a medial member connecting to the printed circuit board.

7. The electrical connector as claimed in claim 6, wherein said medial member has a plurality of terminals assembled thereto and extending downwardly.

8. The electrical connector as claimed in claim 1, wherein said insulative housing comprises a slot defined in the top wall thereof and extending through a front face of the insulative housing.

9. The electrical connector as claimed in claim 8, further comprising a visual indicator mounted into the slot of the insulative housing.

10. The electrical connector as claimed in claim 8, wherein said visual indicator comprises a lighting pipe and a pair of pins extending from the lighting pipe and though a rear wall of the insulative housing.

11. An electrical connector comprising:

an insulative housing defining opposite front and rear faces and four side faces between said opposite front and rear faces, and further defining a receiving cavity in said front face for receiving a plug, and said rear face for mounting to a printed circuit board;

a plurality of contacts disposed in the housing;

a shield structure covering said four side faces of the housing, said shield structure including a first shell essentially covering three of said four side faces and a second shell essentially covering the remaining one of said four side faces; and a joint between the first shell and the second shell extending along an edge region of one of said faces; wherein a first engagement plate of the first shell is engaged with a second engagement plate of the second shell in an overlapped manner along a direction perpendicular to a front-to-back direction of the housing, under a condition that the first plate is located inside of the second plate, and an edge of said first plate is hidden behind a step structure disposed on the edge region of the housing for easy assembling in a lateral direction perpendicular to said front-to-back direction.

12. The electrical connector assembly as claimed in claim 11, wherein said first plate is dimensioned larger than the second plate.

13. The electrical connector as claimed in claim 11, wherein said edge region is wedged for confronting the second plate.

14. The electrical connector as claimed in claim 11, wherein said the wedged edge region does not extend through the whole housing along said front-to-back direction.

15. The electrical connector as claimed in claim 11, wherein said second plate is seated upon the edge region.

* * * * *